United States Patent [19]

De Shon

[11] Patent Number: 4,733,417

[45] Date of Patent: Mar. 29, 1988

[54] STEADY STATE SWIMMING POOL HEAT EXCHANGER

[76] Inventor: Dennis A. De Shon, P.O. Box 3255, Baton Rouge, La. 70821

[21] Appl. No.: 75,086

[22] Filed: Jul. 20, 1987

[51] Int. Cl.[4] ..... E04H 3/18

[52] U.S. Cl. ..... 4/493; 4/661; 165/45; 165/96

[58] Field of Search ..... 4/493, 661; 165/45, 165/96; 126/415, 430

[56] References Cited

U.S. PATENT DOCUMENTS

| | | | |
|---|---|---|---|
| 612,635 | 10/1898 | Taylor | 165/45 |
| 2,554,661 | 5/1951 | Clancy | 165/45 |
| 3,330,333 | 7/1967 | Moss | 165/45 |
| 3,965,972 | 6/1976 | Petersen | 165/45 |
| 4,286,651 | 9/1981 | Steiger et al. | 165/45 |
| 4,483,318 | 11/1984 | Margen | 165/45 X |
| 4,688,717 | 8/1987 | Jungwirth | 165/45 X |

*Primary Examiner*—Henry K. Artis

[57] ABSTRACT

A steady state swimming pool heat exchanger designed to warm the water in swimming pools by the conducting of heat from the constant heat reservoir of the earth into the water in the pool through a heat-conducting rod sunk vertically into the earth beneath the pool. Attached to the rod is a contact plate, mounted on the floor of the pool, which transfers heat energy from the rod to the water. In temperate climates, the earth maintains a constant level of heat of 65 to 70 degrees at a depth of approximately 10 meters. The contact between the earth and the water in the pool provides a steady state transfer of heat to warm the water when the water temperature is below that of the earth reservoir. A non-conducting cover is provided to restrict the heat flux when heating or cooling of the water is not desired.

1 Claim, 1 Drawing Figure

STEADY STATE SWIMMING POOL HEAT EXCHANGER

BACKGROUND OF THE INVENTION

1. Field of the Invention

This invention relates generally to apparatus for heating bodies of water through steady state heat conductivity from the earth's heat reservoir, and more specifically to the heating of swimming pools without the need for fuel consuming heaters.

2. Description of the Prior Art There have been various devices that have been proposed for heating bodies of liquid inexpensively, but these have not proven to be satisfactory as they require the consumption of fuel.

The use of the "Earth Reservoir" as a source of thermal energy is well documented:

Taylor, in U.S. Pat. No. 612,635-Oct. 18, 1898, describes an "apparatus for cooling water" in which a "cylinder being driven or let into the ground to a considerable depth" is used to circulate and cool water "for drinking purposes."

Clancy, in U.S. Pat. No. 2,554,661-May 29, 1951, uses "the subterranean earth as a source of heat" in which to "circulate fluid" for a refrigerator or heat pump.

Moss, in U.S. Pat. No. 3,330,333-July 11, 1967, controls the temperature of communications apparatus by "extending a member of heat conducting material from the interior of the enclosure to a medium of more desirable temperature conditions."

Petersen, in U.S. Pat. No. 3,965,972-June 29, 1976, provides a means of "heating and cooling space within a structure...residential house, greenhouse or commercial building" by pumping fluid from a "hot well."

Steiger, in U.S. Pat. No. 4,286,651-Sept. 1, 1981, uses a "heat pump" to "extract heat from a heat exchange liquid" from a "geothermal pipe" to heat building structures.

McGrath, in U.S. Pat. No. 4,299,270-Nov. 10, 1981, uses a pump to circulate water through "deep earth mass (geothermal energy)" to heat a building.

Sills, in U.S. Pat. No. 4,456,056-June 26, 1984, provides "domestic hot water heating, space heating and space cooling for buildings" by using a heat pump coupled to "the deep earth."

Zeigenhain, in U.S. Pat. No. 4,458,492-July 10, 1984, uses a pump to inject fluid into a "thermally stable...formation" to recover "geothermal energy from subterranean formations".

Jungwirth, in U.S. Pat. No. 4,688,717-Aug. 25, 1987, provides a "heating system for homes and buildings" using reverse cycle refrigeration with "earthen material being a heat source."

Although all of these utilize the "earth reservoir" as a source of thermal energy, none has suggested the use of this resource to heat swimming pools. Moss, although utilizing a solid, rather than a liquid transfer medium, specifically mentions only the application to enclosures for communications apparatus, not swimming pools, both in the description and in the claims.

SUMMARY OF THE INVENTION

The invention is comprised of: a heat-conducting metal rod, in this case copper although any heat conductive material may be used, which is sunk vertically into the ground beneath the water-enclosing walls of a swimming pool and into the heat containing reservoir of the earth; a contact plate mounted on top of the rod, which is recessed into the floor of the swimming pool, in contact with the water; and a seal around the rod to contain the water within the swimming pool. In operation, the apparatus acts to transfer heat contained in the earth reservoir to the water in the swimming pool, according to the laws of Steady State Thermodynamics: a rod placed in contact with a heat reservoir (in this case the earth) at a temperature of T1, and the other in contact with another heat reservoir (in this case the water in the swimming pool) at a temperature of 72 and whereas $T2 \neq T1$, will eventually reach a state in which the properties remain constant in time. In addition, there will be a steady flow of heat energy from the high temperature reservoir to the low temperature reservoir. In temperate geographic areas, the earth reservoir, at a depth of approximately 10 meters maintains a stable temperature of between 65 and 70 degrees Fahrenheit. In these same areas, the mean average winter air temperatures range from 50 to 60 degrees Fahrenheit, and result in the cooling of swimming pool water beneath that level at which swimming is pleasureable. The steady state transfer of heat by the rod from the high temperature earth reservoir to the low temperature liquid in the swimming pool achieves water warming and more comfortable swimming temperatures in those months formerly requiring the employing of energy consuming conventional pool heaters. Included is a non-conducting cover for the contact plate for use should the heat-sink properties of the apparatus not be desired, as in the summer when the apparatus transfers heat from the warmer water of the swimming pool to the cooler earth reservoir, thus reducing the temperature of the water.

OBJECTS AND ADVANTAGES OF THE INVENTION

It is an object of the invention to provide a steady state swimming pool water heater of such character that does not consume fuel.

It is another object of the invention to provide apparatus of this character that is simple in construction and operation.

It is a further object of the invention to provide apparatus of this character that is relatively inexpensive to manufacture and maintain.

The characteristics and advantages of the invention are further sufficiently referred to in connection with the following detailed description of the accompanying drawings, which represent one embodiment.

After considering this example, skilled persons will understand that many variations may be made without departing from the principles disclosed and I contemplate the employment of any structure, arrangements or modes of operation that are properly within the scope of the appended claims.

BRIEF DESCRIPTION OF THE DRAWINGS

Referring to the drawing which is for illustrative purposes only.

DESCRIPTION OF THE PREFERRED EMBODIMENT

Figure 1:
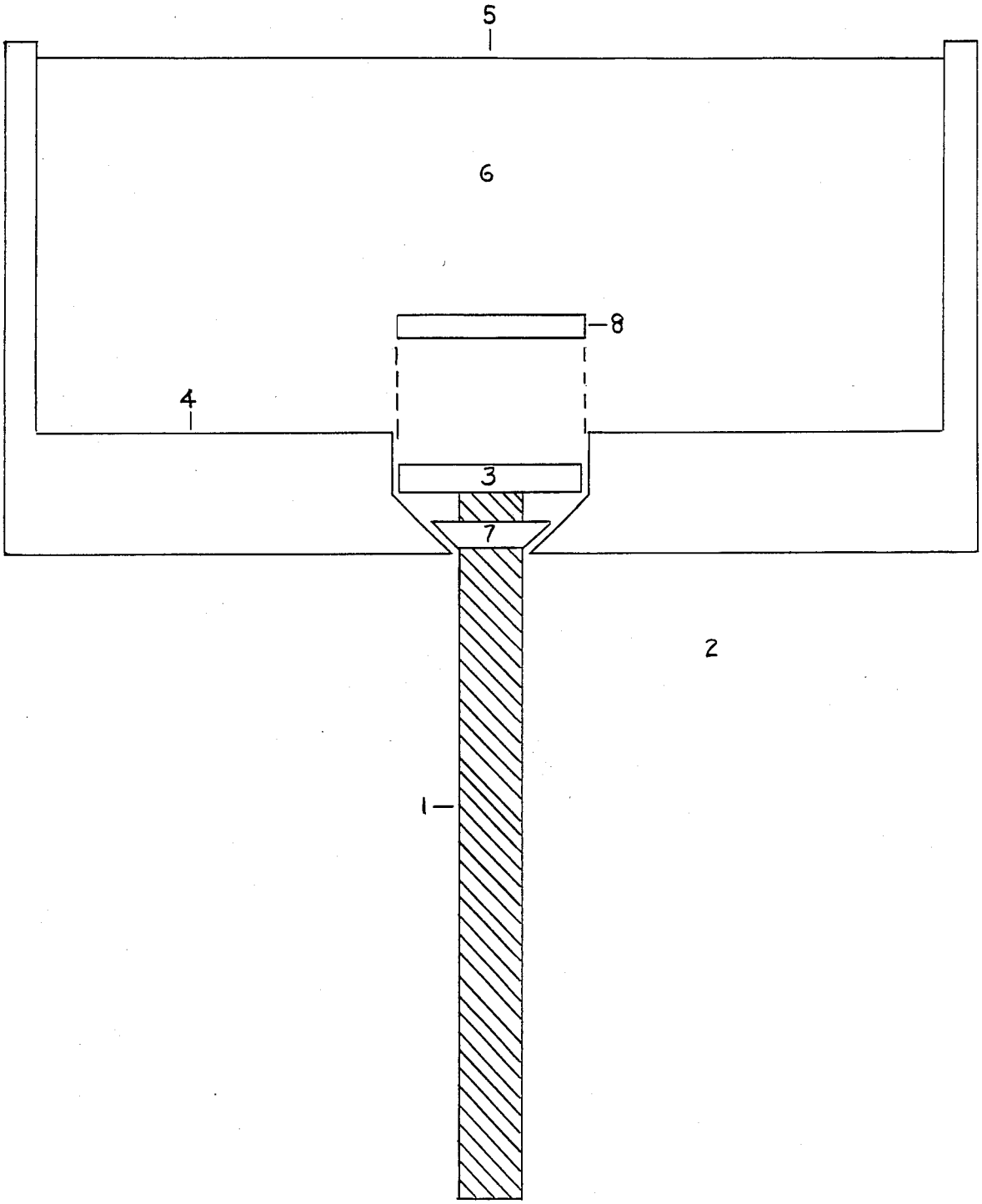
FIG. 1 is a schematic view of apparatus embodying the present invention, cross sectioned to show the rod, plate, seal and cover.

Referring to FIG. 1, there is shown apparatus embodying the present invention. A heat-conducting rod (1), in this case copper, although other materials may be used if desired, is sunk vertically into the earth (2) to a depth at which the stable temperature of the earth, at the location, is reached. The diameter of the rod, and the resultant surface area, are dictated by the extant earth/soil thermal conductivity. A plate (3) is mounted on the top of the rod, and is recessed into the floor (4) of the swimming pool (5), in contact with the water (6) in the pool. The size, and resultant heat-conductive area, of the plate is dictated by the volume of water in the pool. Heat is transferred from the earth to the water in the pool in accordance with Fourier's Law: $Q=-kA(dt/dl)$ BTU/hr.. A seal(7) prevents the water in the pool from escaping around the rod. A nonconducting cover (8) is provided to be placed into position above the plate to restrict the transfer of heat at times when transfer from either pool to earth or earth to pool is desired to be restricted.

That is to say that in the summer, when the environmental temperature surrounding the swimming pool exceeds that of the earth reservoir, the rod will act to convey heat out of the swimming pool and into the earth reservoir, if the cover is not used.

The invention and its attendant advantages will be understood from the foregoing description and it will be apparent that various changes may be made in the form, construction and arrangement of the parts without departing from the spirit or scope thereof or sacrificing its material advantages, the arrangement hereinbefore being merely by way of example; and I do not wish to be restricted to the specific form shown or uses mentioned except as defined in the accompanying claims.

I claim:

1. A steady state swimming pool heat exchanger which transfers the constant heat contained in the earth to heat the water contained in a swimming pool, comprising:

a swimming pool, a heat conducting rod sunk vertically into the earth to a depth at which the stable temperature of the earth may be reached, so as to conduct the heat from the earth to the water in said swimming pool, a plate mounted on the top of the rod and recessed into the floor of the swimming pool to transfer heat from the rod to the water in the swimming pool, a seal positioned around the rod, between said plate and the earth to prevent leakage of the water in the pool, a non-conductive cover for the plate which may be positioned to restrict the flow of heat.

* * * * *